US006675606B1

(12) United States Patent
Jones et al.

(10) Patent No.: US 6,675,606 B1
(45) Date of Patent: Jan. 13, 2004

(54) COOLER WITH COMBINATION ICE PACK AND CANTEEN

(76) Inventors: Birdsall L. Jones, P.O. Box 601 180 Moore St., Harrisburg, OR (US) 97446; Steen M. Jones, P.O. Box 601 180 Moore St., Harrisburg, OR (US) 97446

( * ) Notice: Subject to any disclaimer, the term of this patent is extended or adjusted under 35 U.S.C. 154(b) by 0 days.

(21) Appl. No.: 10/186,480

(22) Filed: Jun. 28, 2002

(51) Int. Cl.[7] ..... F25D 3/08
(52) U.S. Cl. ..... 62/457.7; 62/441
(58) Field of Search ..... 62/441, 457.1, 62/457.3, 457.4, 457.5, 457.7

(56) References Cited

U.S. PATENT DOCUMENTS 4,441,336 A * 4/1984 Cannon ..... 62/457
5,723,063 A * 3/1998 Jie ..... 252/70
6,422,032 B1 * 7/2002 Greene ..... 62/457.2

* cited by examiner

*Primary Examiner*—Timothy L. Maust
*Assistant Examiner*—Malik N. Drake
(74) *Attorney, Agent, or Firm*—David S. Alavi

(57) ABSTRACT

A cooler is described including at least one combination ice pack and canteen. A container with a dispensing opening is partially filled with water, frozen, and then placed in the cooler along with cooler contents. The ice in the container maintains the cooler contents at a reduced temperature, so that the container serves as an ice pack. Melt-water resulting from melting of the ice while the container is in the cooler may be dispensed as drinking water, so that the container also serves as a canteen. A preferred combination ice pack and canteen comprises a flexible, substantially water-tight bag with an integral, flexible, re-sealable pour spout. The bag is partially filled and preferably arranged in a substantially flattened shape for freezing. Two such flattened ice packs may be placed above and below, or on either side of, the cooler contents.

31 Claims, 6 Drawing Sheets

FIG. 9
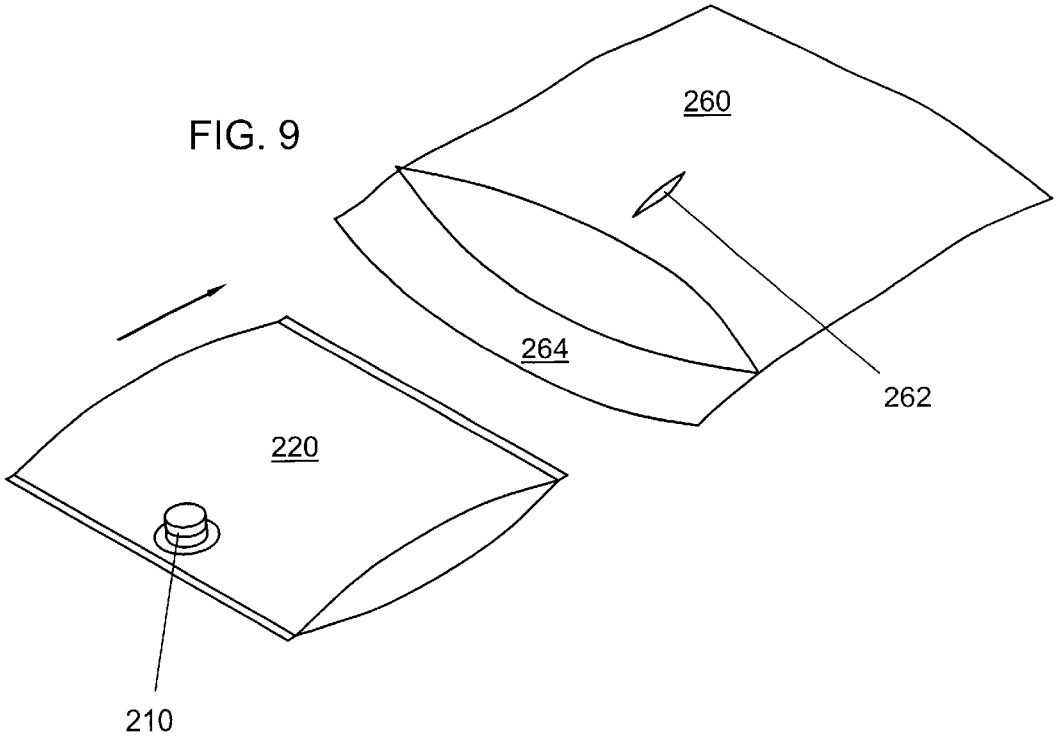
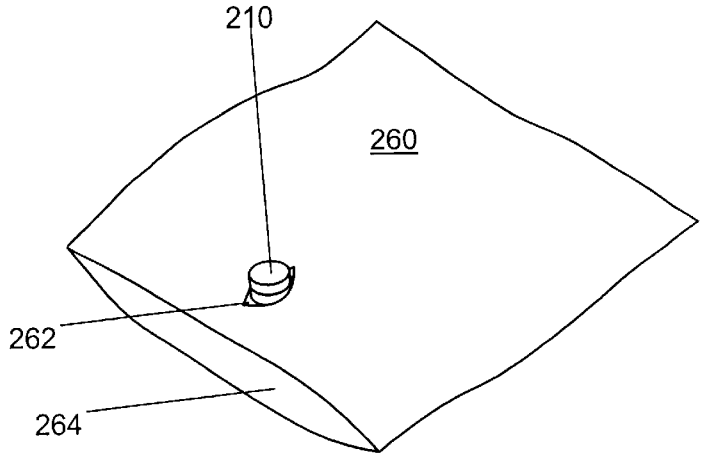
FIG. 10

COOLER WITH COMBINATION ICE PACK AND CANTEEN

FIELD OF THE INVENTION

The field of the present invention relates to portable insulated containers, or coolers. In particular, a cooler including a combination ice pack and canteen is described herein.

BACKGROUND

Portable insulated containers, or coolers, are well-known and frequently used for transporting food, drink, and/or other items at lower-than-ambient temperature, particularly perishable items in order to maintain freshness. Most portable coolers take the form of a box or chest with a top or lid that may be opened or even removed, allowing access to the contents contained therein. The bottom, sides, and lid of the cooler are insulated to reduce heat flow into the interior from the surroundings, thereby enabling a reduced temperature to be maintained within the cooler. The insulation may be provided by use of insulating material to form the cooler (styrofoam, for example), or may be provided using a multi-layer construction with an insulating gap between the layers (Thermos®-like, for example).

However the insulation is provided, the reduced temperature within the cooler is provided by including therein a cold substance, most typically ice or other frozen substance. Frozen substances offer greater cooling capacities than non-frozen substances, since much of the unwanted heat entering the cooler serves to melt the frozen substance before warming the other contents of the cooler. Plain water ice is cheap and readily available, and is the most common frozen substance used in portable coolers. Usually provided in small chunks or cubes, the ice is often simply poured into the cooler along with the cooler contents and the lid closed, keeping the cooler contents at a reduced temperature (relative to an ambient temperature) for an extended period, usually at least several hours.

There are of course several well-known disadvantages associated with the use of ice in coolers. Perhaps most significantly, as the ice melts the cooler tends to fill with water. Unless care is taken (and sometimes even when care is taken), the contents of the cooler may become wet. This is not a problem for some items (canned or bottled beverages, for example) but may be quite undesirable for others (sandwiches, for example). In addition, the ice (and the water resulting from melting) is also quite heavy, making it more difficult to carry the portable cooler when filled. This may be mitigated in part by providing a drain near the bottom of the cooler for allowing the melt-water to drain. Draining a cooler is often a cumbersome, unwieldy, and messy process, particularly when cooler contents remain within the cooler. Many a cooler has been ruined when the drain becomes damaged and no longer seals properly.

It is therefore desirable to provide a cooler that overcomes these undesirable aspects of prior coolers. In particular, it is desirable: to provide a cooler wherein water from melted ice is separated from the contents of the cooler; to provide a cooler wherein the overall weight of the cooler and contents may be reduced; to provide a cooler that need not be drained of melt-water.

SUMMARY

Certain aspects of the present invention may overcome one or more drawbacks of the previous art and/or advance the state-of-the-art of coolers, and in addition may meet one or more of the following objects:

- To provide a cooler with a combination ice pack and canteen;
- To provide a cooler with a combination ice pack and canteen wherein the combination ice pack and canteen may be filled with water and the water frozen to form ice;
- To provide a cooler with a combination ice pack and canteen wherein the ice in the combination ice pack and canteen serves to maintain the cooler contents at a reduced temperature;
- To provide a cooler with a combination ice pack and canteen wherein the melt-water from the ice is separated from the contents of the cooler;
- To provide a cooler with a combination ice pack and canteen wherein the melt-water from the ice need not be drained form the cooler;
- To provide a cooler with a combination ice pack and canteen wherein the melt-water from the ice may be dispensed as drinking water;
- To provide a cooler with a combination ice pack and canteen wherein the combination ice pack and canteen comprises a flexible substantially water-tight bag;
- To provide a cooler with a combination ice pack and canteen wherein the combination ice pack and canteen includes a flexible re-sealable pour spout; and
- To provide a cooler with a combination ice pack and canteen wherein the overall weight and volume of the cooler and contents may be reduced.

One or more of the foregoing objects may be achieved in the present invention by a method for maintaining cooler contents at a reduced temperature and for providing drinking water, the method comprising the steps of: a) partially filling a combination ice pack and canteen with water; b) freezing the ice pack; c) placing the ice pack in the cooler along with cooler contents; and d) dispensing melt-water from the ice pack as drinking water, the ice pack thereby also serving as a canteen. The combination ice pack and canteen comprises a substantially water-tight container including a re-sealable dispensing opening. One or more of the foregoing objects may be achieved in the present invention by a cooler with a combination ice pack and canteen, comprising: a) an insulated cooler; and b) at least one combination ice pack and cooler, including a substantially water-tight container including a re-sealable dispensing opening. The combination ice pack and canteen preferably comprises a flexible, substantially water-tight bag with an integral, flexible, re-sealable pour spout. The bag may be partially filled with water, preferably arranged in a substantially flattened shape, and the water frozen. The ice pack and ice are then placed within the cooler with cooler contents, thereby maintaining the cooler contents at a reduced temperature when the cooler lid is shut. Melting of ice in the ice pack results in melt-water that may be dispensed from the ice pack as drinking water, the ice pack thereby serving as a canteen.

Additional objects and advantages of the present invention may become apparent upon referring to the preferred and alternative embodiments of the present invention as illustrated in the drawings and described in the following written description and/or claims.

BRIEF DESCRIPTION OF THE DRAWINGS

FIG. 9 is an isometric view of a horizontally arranged combination ice pack and canteen with a protective layer according to the present invention.

FIG. 10 is an isometric view of a horizontally arranged combination ice pack and canteen with a protective layer according to the present invention.

The embodiments illustrated in the Figures are exemplary and should not be construed as limiting the scope of inventive concepts disclosed and/or claimed herein.

DETAILED DESCRIPTION OF PREFERRED AND ALTERNATIVE EMBODIMENTS

Figure 1:
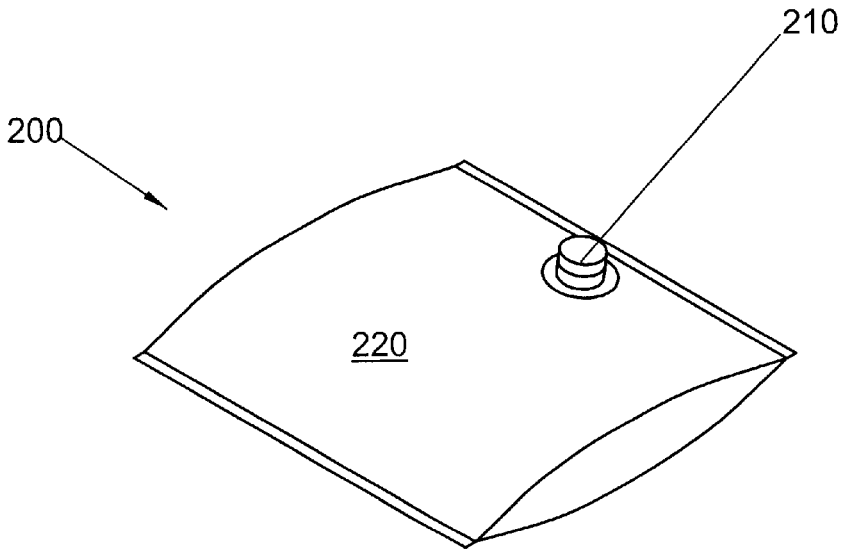
FIG. 1 is an isometric view of a combination ice pack and canteen according to the present invention.
Figure 4:
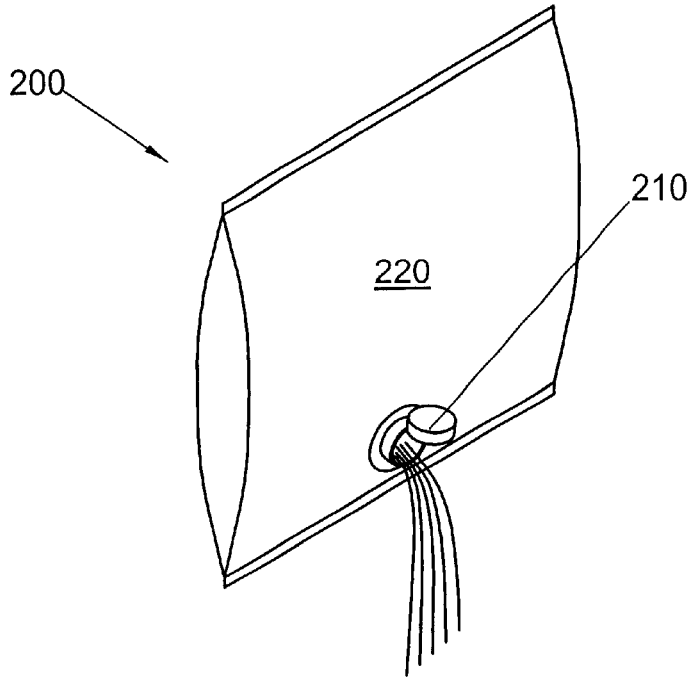
FIG. 4 is a combination ice pack and canteen used as a canteen according to the present invention.
Figure 2:
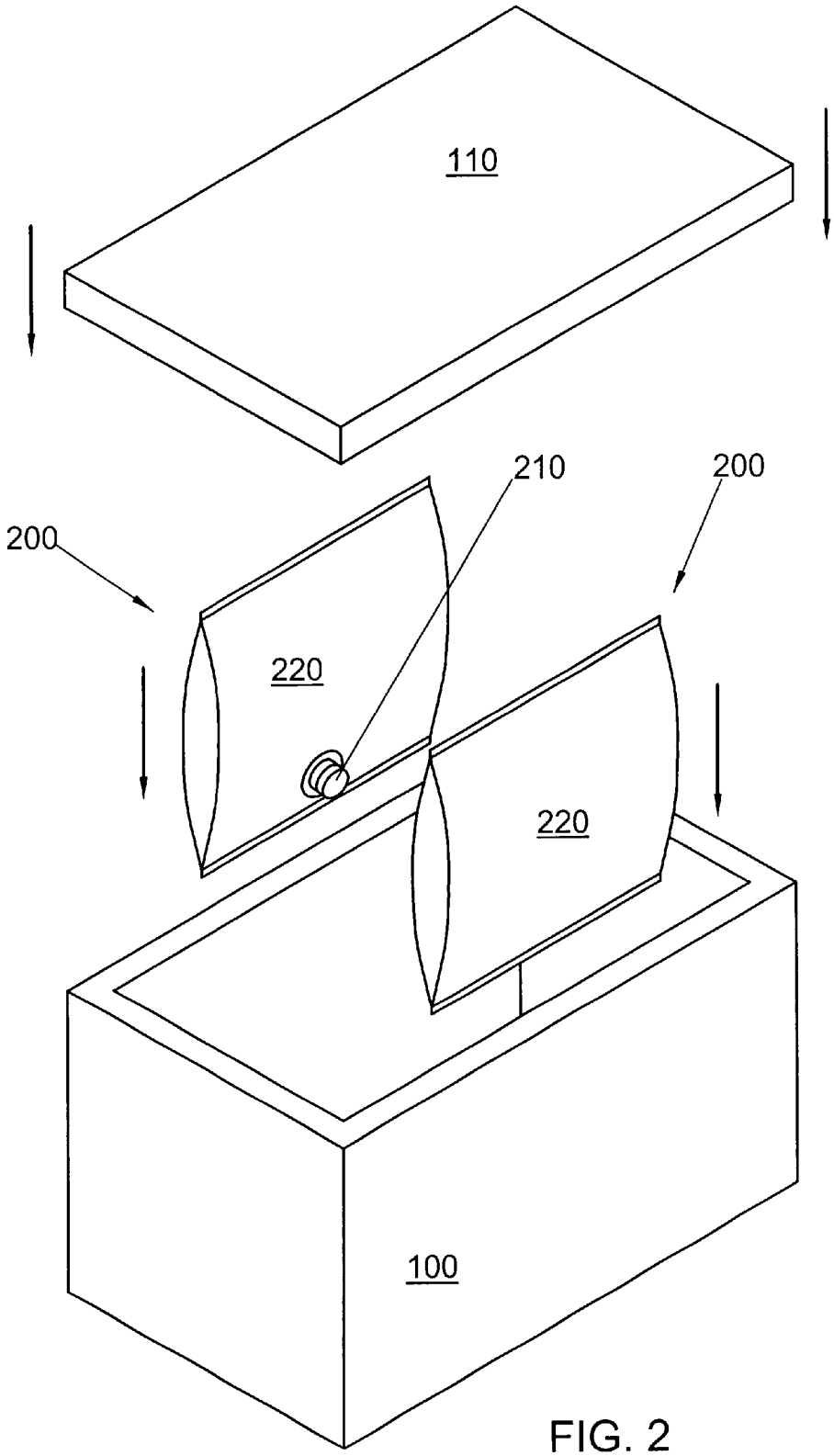
FIG. 2 is an isometric view of two vertically arranged ice packs placed within a cooler according to the present invention.
Figure 3:
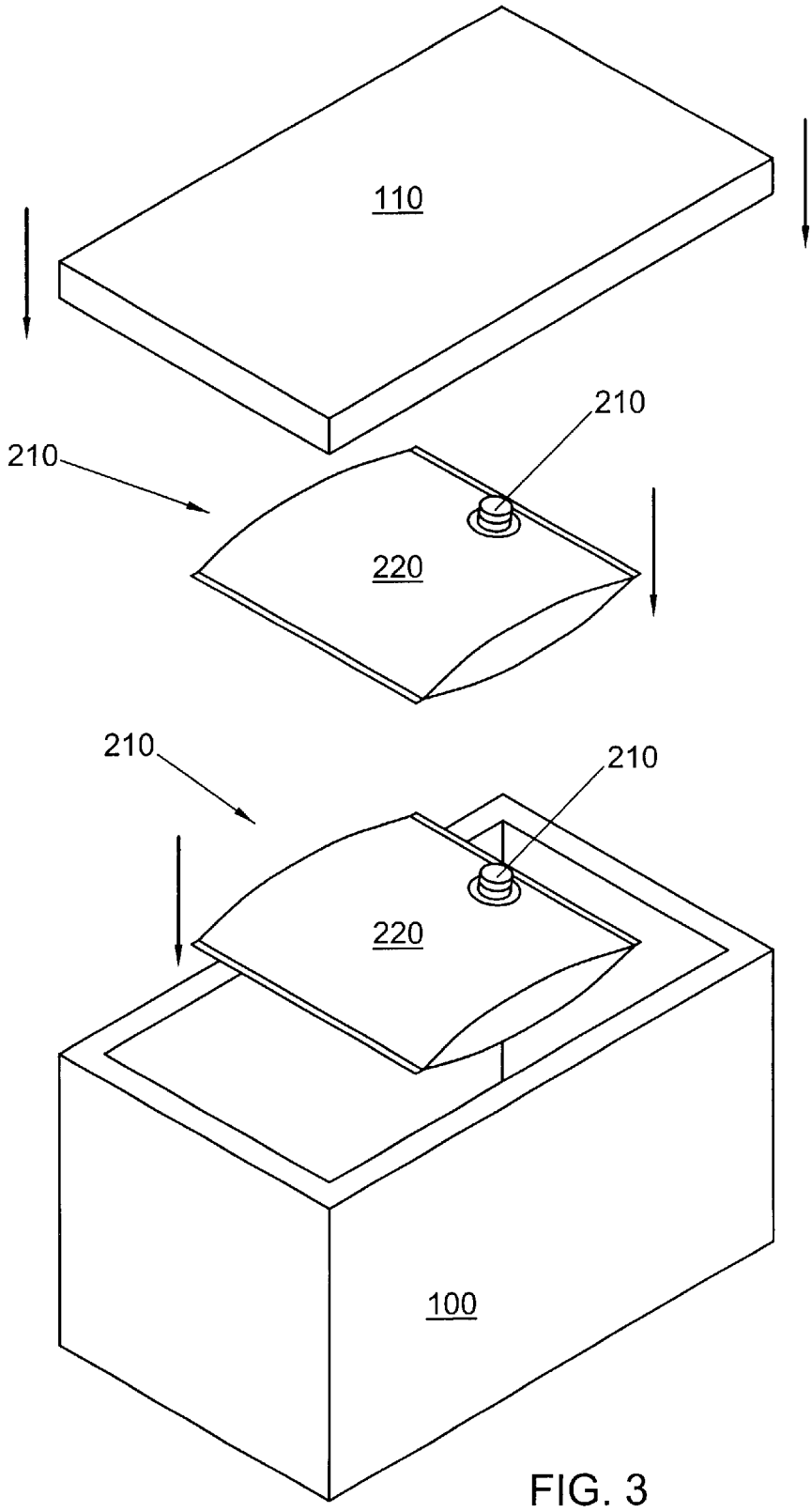
FIG. 3 is an isometric view of two horizontally arranged ice packs placed within a cooler according to the present invention.

FIGS. 1 through 4 illustrate a cooler according to the present invention including a pair of combination ice packs and canteens. Cooler 100 may be a cooler of any suitable size, shape, and type, and typically has an open top and an insulated lid 110 for closing the top and enclosing the interior volume of the cooler. Ice packs 200 preferably each comprise a flexible, water-proof bag 220 formed with an integral, flexible, re-sealable pour spout 210 (FIG. 1). Ice packs 200 are preferably partially filled with drinking water (typically one-half to two-thirds full to allow for expansion upon freezing) and arranged in a substantially flattened shape for freezing. Once frozen (and substantially rigid), the ice packs 200 are placed within the cooler 100 as shown in FIGS. 2 and 3. The cooler may then be filled with any desired contents (food, drink, condiments, and the like; not shown) and shut with the lid 110 to maintain the interior volume of the cooler and the enclosed contents at a reduced temperature relative to an ambient temperature. As heat inevitably leaks into the cooler, much of it will be absorbed by melting of the ice in the ice packs. As the ice in the ice packs melts, the resulting melt-water becomes available for consumption as chilled drinking water, and ice packs 200 may therefore also each serve as a canteen for chilled drinking water (FIG. 4). The ice pack/canteen 200 may be removed from the cooler, re-sealable pour spout 210 is simply opened, the melt-water dispensed therefrom (FIG. 4), and the pour spout re-sealed. Ice pack/canteen 200, with the remaining ice still contained therein, may again be placed within the cooler 100 to continue to maintain the cooler contents at a reduced temperature. While dispensing chilled drinking water is preferred, the melt-water may also be dispensed as drinking water after reaching ambient temperature. The ice packs are preferably maintained in a sanitary condition to avoid contamination of the drinking water.

Each combination ice pack/canteen 200 is preferably provided in the form of a lightweight flexible bag-type container 220 having an integral, re-sealable pour spout 210 (FIG. 1). Other functionally equivalent re-sealable dispensing openings may be employed as well. Suitable containers of this sort or routinely used in the wine industry, for example, to provide the liner and dispensing spout for so-called "boxed wine". Such containers should be constructed from plastic sheet or other similarly suitable material that is water-tight and sufficiently flexible, strong, and durable to contain the drinking water and/or ice. Mylar® is a preferred material for the bag-type containers, and may be employed with or without a reflective surface coating or layer. While freezing the ice pack/canteen in a substantially flattened shape may be preferred for enabling placement of the ice pack and cooler contents within the cooler, it may be desirable in certain situations to arrange the ice pack in some other shape to accommodate specific cooler contents. For example, the ice pack may be shaped to fit around a bottle, jar, or other container or object to be placed in the cooler.

As shown in FIG. 3, substantially flattened ice packs 200 may be arranged in a substantially horizontal orientation, with a first ice pack lying on the bottom of the cooler 100, the cooler contents (not shown) placed on top of the first ice pack, and the second ice pack placed on top of the cooler contents. Alternatively, substantially flattened ice packs 200 may be arranged in a substantially vertical orientation along opposite sides of the cooler 100, as shown in FIG. 2, with the cooler contents (not shown) placed between them. Other shapes and/or arrangements of the ice packs and cooler contents may be equivalently employed. It may be desirable to provide a barrier or protective layer 230, as shown in FIGS. 5 through 10, between the ice packs and the other cooler contents for protecting the ice packs from damage. A small towel or other similar fabric sheet wrapped around, laid over, and/or laid below each ice pack may be employed to serve this purpose (depending on the arrangement of the ice packs and cooler contents; refer to discussion above). Instead of a towel, a flexible sheet of styrofoam, foam rubber, neoprene, or other similarly suitable material may be alternatively employed for protecting the ice packs from damage. A barrier or protective layer 230 thus provided may also prevent direct contact between the ice packs and the cooler contents, which may be desirable if the cooler contents may be damaged by temperatures that are too low, or to prevent wetting of the cooler contents by moisture condensed on the ice pack surfaces.

Figure 5:
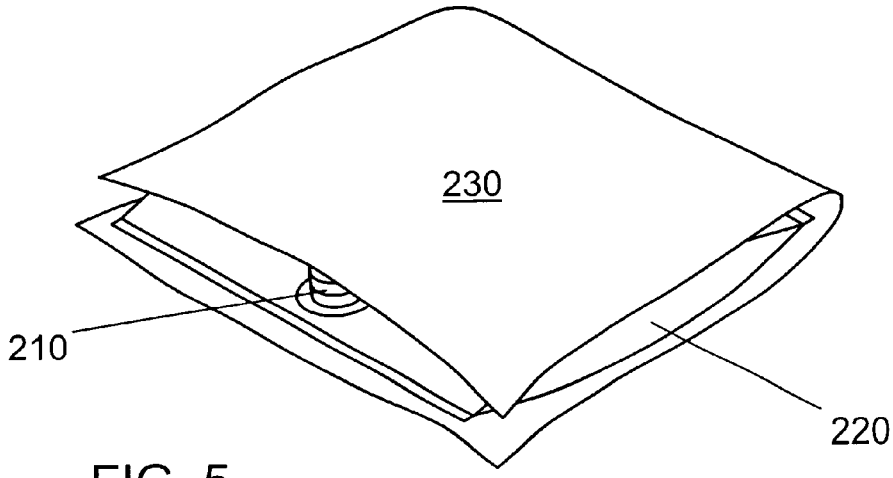
FIG. 5 is an isometric view of a horizontally arranged combination ice pack and canteen with a protective layer according to the present invention.
Figure 6:
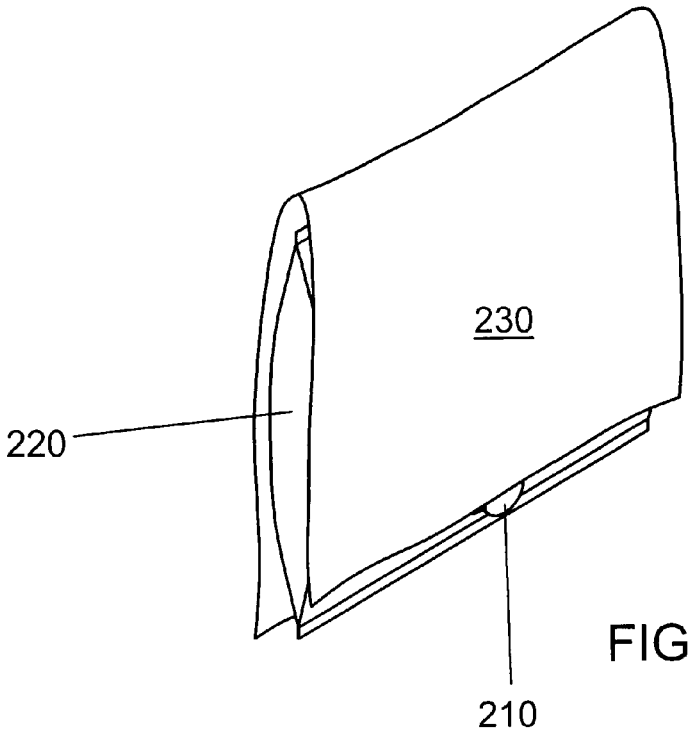
FIG. 6 is an isometric view of a vertically arranged combination ice pack and canteen with a protective layer according to the present invention.
Figure 7:
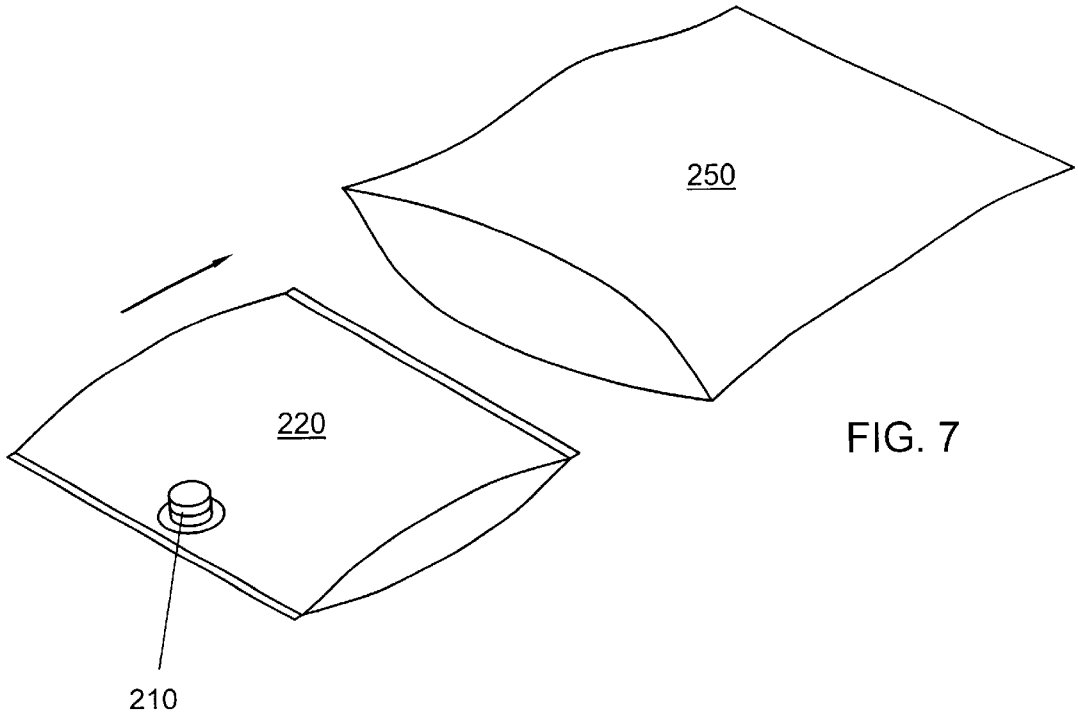
FIG. 7 is an isometric view of a horizontally arranged combination ice pack and canteen with a protective layer according to the present invention.
Figure 8:
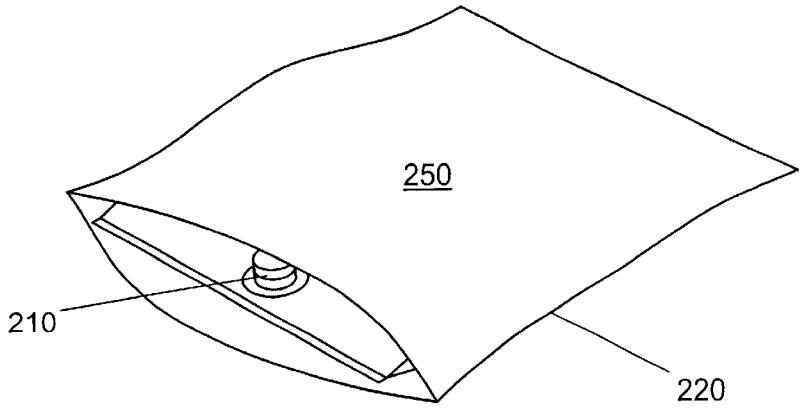
FIG. 8 is an isometric view of a horizontally arranged combination ice pack and canteen with a protective layer according to the present invention.

Instead of a simple sheet wrapped around ice packs 200 as shown in FIGS. 5 and 6, the protective layer may instead be provided in the form of a flexible pocket or pouch, as shown in FIGS. 7–10. In FIGS. 7 and 8, ice pack 200 is placed within an open-ended pouch 250, thereby providing a protective layer between the cooler contents and ice pack 200. In FIGS. 9 and 10, a pouch 260 is provided with a flap 264 and an opening 262. Ice pack 200 is placed within pouch 260 so that the dispensing opening (pour spout 210 in this example) is accessible through opening 262 without removing ice pack 200 from the pouch 260. Flap 264 may be folded over to retain ice pack 200 within the pouch 260.

By using water-tight ice packs, the cooler contents are kept dry, since the melt-water is contained within the ice packs. Weight and space (volume) in the cooler are conserved since the ice packs also serve as a source of drinking water, thereby reducing the amount of water or other beverages that must be carried in the cooler (as cooler contents). The overall weight of the cooler is also reduced, initially since the ice packs double as cooling elements and sources of drinking water, and later since the weight of the ice packs decreases as the melt-water is consumed as drinking water. Even if the melt-water is not consumed, the melt-water may be readily removed from the cooler (to reduce weight) by removing the ice pack from the cooler and simply pouring out the melt-water from the bags. This is a much more convenient procedure than draining the cooler directly.

In an alternative embodiment of the present invention, each combination ice pack/canteen may be provided in a form comprising a bottle or other container having a well-defined shape and including a re-sealable pour-spout, lid, or other functionally equivalent dispensing opening. Such a container may be substantially rigid, or may be solid but deformable and function as a squeeze-bottle. In either case, the container may be partially filled with water, frozen, and placed within the cooler along with the other cooler contents. The ice within the container serves to maintain the interior volume of the cooler and the enclosed contents at a reduced temperature, while the melt-water may be consumed as drinking water (i.e., the container may serve as a canteen).

The present invention has been set forth in the forms of its preferred and alternative embodiments. It is nevertheless intended that modifications to the disclosed cooler with combination ice pack and canteen may be made without departing from inventive concepts disclosed and/or claimed herein.

What is claimed is:

1. A method for maintaining cooler contents at a reduced temperature and for providing drinking water, the method comprising the steps of:

partially filling at least one combination ice pack and canteen with drinking water and sealing the combination ice pack and canteen, the combination ice pack and canteen comprising a substantially water-tight container including a re-sealable dispensing opening;

freezing the drinking water within the combination ice pack and canteen to form ice;

placing the combination ice pack and canteen with the ice contained therein within an insulated cooler along with the cooler contents and covering an open top of the cooler with a lid, thereby maintaining the cooler contents at a reduced temperature relative to an ambient temperature; and after at least a portion of the ice has melted with the combination ice pack and canteen in the cooler, removing the combination ice pack and canteen from the cooler; and after removing the combination ice pack and canteen from the cooler, dispensing the drinking water from the combination ice pack and canteen through the dispensing opening.

2. The method of claim 1, comprising the additional steps of:

after dispensing the drinking water, re-sealing the re-sealable dispensing opening; and after re-sealing the dispensing opening, replacing the combination ice pack and canteen with remaining ice contained therein within the cooler along with the cooler contents and covering the open top of the cooler with the lid, thereby continuing to maintain the cooler contents at a reduced temperature relative to an ambient temperature.

3. The method of claim 1, the re-sealable dispensing opening comprising an integral, flexible, re-sealable pour spout.

4. The method of claim 1, the container comprising a flexible substantially water-proof bag.

5. The method of claim 4, further comprising the step of arranging the bag in a substantially flattened shape after partially filling the bag with water and before freezing the water.

6. The method of claim 5, further comprising the steps of:

placing the combination ice pack and canteen with the ice contained therein in a substantially horizontal position in the cooler at the bottom thereof;

placing the cooler contents in the cooler over the combination ice pack and canteen; and placing a second combination ice pack and canteen with ice contained therein in a substantially horizontal position in the cooler over the cooler contents, the second combination ice pack and canteen being adapted in a manner substantially similar to the first combination ice pack and canteen.

7. The method of claim 5, further comprising the steps of:

placing the combination ice pack and canteen and the ice contained therein in a substantially vertical position in the cooler along a first side thereof;

placing a second combination ice pack and canteen with ice contained therein in a substantially vertical position in the cooler along a second side thereof opposite the first combination ice pack and canteen, the second combination ice pack and canteen being adapted in a manner substantially similar to the first combination ice pack and canteen; and placing the cooler contents in the cooler between the first combination ice pack and canteen and the second combination ice pack and canteen.

8. The method of claim 4, further comprising the step of placing a protective layer between the flexible bag and the cooler contents, thereby substantially preventing contact between the flexible bag and the cooler contents.

9. The method of claim 8, the protective layer comprising a flexible fabric sheet.

10. The method of claim 8, the protective layer comprising a flexible styrofoam sheet.

11. The method of claim 8, the protective layer comprising a flexible neoprene sheet.

12. The method of claim 8, the protective layer comprising a flexible fabric pouch.

13. The method of claim 8, the protective layer comprising a flexible styrofoam pouch.

14. The method of claim 8, the protective layer comprising a flexible neoprene pouch.

15. The method of claim 8, the protective layer comprising a flexible pouch, the pouch including: a flap adapted for retaining the combination ice pack and canteen within the pouch when the flap is folded over; and an opening adapted for enabling access to the dispensing opening when the combination ice pack and canteen is within the pouch.

16. The method of claim 4, the bag comprising Mylar®.

17. The method of claim 16, the Mylar® including a reflective coating.

18. A cooler with a combination ice pack and canteen, comprising:

an insulated cooler with an open top and including a lid for covering the open top; and at least one combination ice pack and canteen, comprising a flexible substantially water-proof bag and an integral flexible re-sealable pour spout, the combination ice pack and canteen being adapted for receiving drinking water therein, for having the water frozen therein to form ice, and for containing the drinking water and the ice therein, the combination ice pack and canteen being adapted for being placed with the ice contained therein within the cooler, thereby maintaining other contents placed within the cooler at a reduced temperature relative to an ambient temperature when the lid covers the open top of the cooler, the combination ice pack and canteen being adapted for containing the drinking water upon melting of the ice therein while the combination ice pack and canteen is in the cooler, the combination ice pack and canteen being adapted for dispensing the drinking water through the dispensing opening.

19. The apparatus of claim 18, the bag being adapted for assuming a substantially flattened shape when partially filled with water and for maintaining the substantially flattened shape upon freezing of the water.

20. The apparatus of claim 19, the cooler and the combination ice pack and canteen being adapted for enabling placement of the combination ice pack and canteen and the ice contained therein in a substantially horizontal position beneath the cooler contents, the apparatus including a second combination ice pack and canteen adapted in a manner substantially similar to the first combination ice pack and canteen, the cooler and the second combination ice pack and canteen being adapted for enabling placement of the second combination ice pack and canteen and ice contained therein in a substantially horizontal position over the cooler contents.

21. The apparatus of claim 19, the cooler and the combination ice pack and canteen being adapted for enabling placement of the combination ice pack and canteen and the ice contained therein in a substantially vertical position along a first side of the cooler, the apparatus including a second combination ice pack and canteen adapted in a manner substantially similar to the first combination ice pack and canteen, the cooler and the second combination ice pack and canteen being adapted for enabling placement of the second combination ice pack and canteen and ice contained therein in a substantially vertical position along a second side of the cooler opposite the first combination ice pack and canteen with the cooler contents therebetween.

22. The apparatus of claim 18, further comprising a protective layer for substantially preventing contact between the flexible bag and the cooler contents.

23. The apparatus of claim 22, the protective layer comprising a flexible fabric sheet.

24. The apparatus of claim 22, the protective layer comprising a flexible styrofoam sheet.

25. The apparatus of claim 22, the protective layer comprising a flexible neoprene sheet.

26. The apparatus of claim 22, the protective layer comprising a flexible fabric pouch.

27. The apparatus of claim 22, the protective layer comprising a flexible styrofoam pouch.

28. The apparatus of claim 22, the protective layer comprising a flexible neoprene pouch.

29. The apparatus of claim 22, the protective layer comprising a flexible pouch, the pouch including: a flap adapted for retaining the combination ice pack and canteen within the pouch when the flap is folded over; and an opening adapted for enabling access to the dispensing opening when the combination ice pack and canteen is within the pouch.

30. The apparatus of claim 16, the bag comprising Mylar®.

31. The apparatus of claim 30, the Mylar® including a reflective coating.

* * * * *